US010568409B2

(12) United States Patent
Carpenter

(10) Patent No.: US 10,568,409 B2
(45) **Date of Patent: *Feb. 25, 2020**

(54) COLLAR SECURABLE TO PORTABLE DEVICE

(71) Applicant: Thomas Gerard Carpenter, Tucson, AZ (US)

(72) Inventor: Thomas Gerard Carpenter, Tucson, AZ (US)

( * ) Notice: Subject to any disclaimer, the term of this patent is extended or adjusted under 35 U.S.C. 154(b) by 5 days.

This patent is subject to a terminal disclaimer.

(21) Appl. No.: 15/998,001

(22) Filed: Jun. 11, 2018

(65) Prior Publication Data

US 2019/0374015 A1 Dec. 12, 2019

(51) Int. Cl.
*A45F 5/02* (2006.01)

(52) U.S. Cl.
CPC ..... *A45F 5/021* (2013.01); *A45F 2200/0516* (2013.01)

(58) Field of Classification Search
CPC ..... A45F 5/0521
USPC ..... 224/666
See application file for complete search history.

(56) References Cited

U.S. PATENT DOCUMENTS 4,046,295 A * 9/1977 Eichler ..... A45F 5/02 224/242
4,485,946 A * 12/1984 Liautaud ..... A45F 5/021 224/196
4,858,798 A * 8/1989 Siddoway ..... A45F 5/02 224/242
5,038,400 A * 8/1991 Baracat ..... H04B 1/3877 455/347
5,450,993 A * 9/1995 Guerrero ..... A45F 5/02 206/305
5,627,727 A * 5/1997 Aguilera ..... G06F 1/1626 361/679.43
6,053,759 A * 4/2000 Kunert ..... H01R 13/62933 439/376
6,364,187 B1 * 4/2002 Castellano ..... A45F 5/02 224/236
6,848,662 B2 * 2/2005 Paramonoff ..... E05C 3/14 248/222.11
7,757,913 B2 * 7/2010 Fichera ..... A45F 5/02 224/197
7,889,860 B2 * 2/2011 Tinoco ..... B60R 11/02 379/455
8,485,405 B2 * 7/2013 Crye ..... F41A 9/65 224/251
8,985,413 B1 * 3/2015 Selsor ..... A45F 5/021 224/269
9,781,986 B2 * 10/2017 Merzon ..... A45C 11/00
2015/0014376 A1 * 1/2015 Dannan ..... A45F 5/021 224/250
2017/0280863 A1 * 10/2017 Simon ..... A45F 5/06

* cited by examiner

*Primary Examiner* — Nathan J Newhouse
*Assistant Examiner* — Lester L Vanterpool

(57) ABSTRACT

Embodiments of a collar, which may be adapted for removably securing a portable device to a user, are disclosed. In embodiments, the collar may be secured to the portable device, wherein a retaining clip may be inserted into a receiving volume which restricts movement of a claw in contact with a surface of the portable communications device.

18 Claims, 3 Drawing Sheets

COLLAR SECURABLE TO PORTABLE DEVICE

BACKGROUND

1. Field

The present disclosure relates generally to equipment that may be used, for example, to secure a portable device to an article of clothing worn by a user, such as a belt, for example, so that the portable device may be immediately accessible to the user.

2. Information

Emergency services personnel may, at times, have a need for immediate access to a portable communications device. Thus, in many instances, emergency services personnel may wish to secure a portable communications device to a belt, or other article of clothing, such as protective clothing, for example, so that the emergency services personnel can immediately grasp and operate the communications device.

However, in general, equipment used to secure a portable communications device to an article of clothing or another object must not impede device functionality. For example, if the portable communications device is equipped with a display, a device used to secure the communications device to an article of clothing must not obstruct viewing of the display. In another example, equipment used to secure portable communications device to an article of clothing must remain secured to the communications device during charging, for example, so as to permit emergency personnel workers e.g. (first responders) to quickly grasp a portable communications device and rapidly advance to the scene of an emergency, for example. However, currently-available equipment, which may be used to secure a portable communications device to an article of protective clothing, may fall short of meeting operational expectations and needs.

BRIEF DESCRIPTION OF DRAWINGS

Claimed subject matter is particularly pointed out and/or distinctly claimed in the concluding portion of the specification. However, both as to organization and/or method of operation, together with objects, features, and/or advantages thereof, claimed subject matter may be understood by reference to the following detailed description if read with the accompanying drawings in which:

Figure 1:
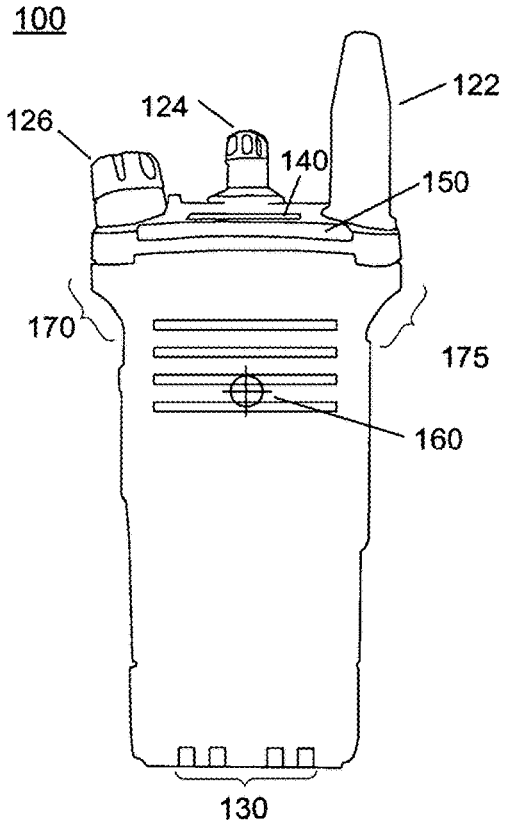
FIG. 1 is a view of a portable communications device, to which a collar may be secured, according to an embodiment.

Reference is made in the following detailed description to accompanying drawings, which form a part hereof, wherein like numerals may designate like parts throughout to indicate corresponding and/or analogous components. It will be appreciated that components illustrated in the figures have not necessarily been drawn to scale, such as for simplicity and/or clarity of illustration. For example, dimensions of some components may be exaggerated relative to other components. Further, it is to be understood that other embodiments may be utilized. Furthermore, structural and/or other changes may be made without departing from claimed subject matter. It should also be noted that directions and/or references, for example, up, down, top, bottom, and so on, may be used to facilitate discussion of drawings and/or are not intended to restrict application of claimed subject matter. Therefore, the following detailed description is not to be taken to limit claimed subject matter and/or equivalents.

DETAILED DESCRIPTION

In the following detailed description, numerous specific details are set forth to provide a thorough understanding of claimed subject matter. For purposes of explanation, specific numbers, systems, and/or configurations are set forth, for example. However, it should be apparent to one skilled in the relevant art having benefit of this disclosure that claimed subject matter may be practiced without specific details. In other instances, well-known features may be omitted and/or simplified so as not to obscure claimed subject matter. While certain features have been illustrated and/or described herein, many modifications, substitutions, changes, and/or equivalents may occur to those skilled in the art. It is, therefore, to be understood that appended claims are intended to cover any and all modifications and/or changes as fall within claimed subject matter.

Reference throughout this specification to "one implementation," "an implementation," "one embodiment," "an embodiment" and/or the like may mean that a particular feature, structure, or characteristic described in connection with a particular implementation or embodiment may be included in at least one implementation or embodiment of claimed subject matter. Thus, appearances of such phrases, for example, in various places throughout this specification are not necessarily intended to refer to the same implementation or to any one particular implementation described. Furthermore, it is to be understood that particular features, structures, or characteristics described may be combined in various ways in one or more implementations. In general, of course, these and other issues may vary with context. Therefore, particular context of description or usage may provide helpful guidance regarding inferences to be drawn.

In this context, the terms "coupled," "connected," and/or similar terms, may be used. It should be understood that these terms are not intended as synonyms. Rather, "connected" may be used to indicate that two or more elements or other components, for example, are in direct physical and/or electrical contact; while, "coupled" may mean that two or more components are in direct physical or electrical contact; however, "coupled" may also mean that two or more components are not in direct contact, but may nonetheless co-operate or interact. The term "coupled" may also be understood to mean indirectly connected, for example, in an appropriate context.

The terms, "and," "or," "and/or," and/or similar terms, as used herein, may include a variety of meanings that also are expected to depend at least in part upon the particular context in which such terms are used. Typically, "or" if used to associate a list, such as A, B, or C, is intended to mean A, B, and C, here used in the inclusive sense, as well as A, B, or C, here used in the exclusive sense. In addition, the term "one or more" and/or similar terms may be used to describe any feature, structure, and/or characteristic in the singular and/or may be used to describe a plurality or some other combination of features, structures and/or characteristics. In this context, the term "between" and/or similar terms are understood to include "among" if appropriate for the particular usage. Likewise, in this context, the terms "accommodate," "comply with" and/or similar terms are understood to include substantial compliance or substantial compatibility. Though it should be noted that these are merely illustrative examples and claimed subject matter is not limited to this example.

As previously mentioned, in many environments, such as environments involving emergency service personnel, such as first responders, for example, a portable device, such as a portable two-way radio, may be removably secured to an article of clothing. For example, a portable two-way radio may be at least temporarily affixed to a user's belt, or other article of clothing, such as fire-protection clothing, so that the emergency services worker may have immediate access to the two-way radio. In many instances, a premium may be placed on immediate accessibility of the device especially during circumstances in which the emergency services worker is wearing gloves, a helmet, and/or other protective equipment.

However, any device or apparatus utilized to secure a portable communications device, for example, to an article of clothing, should not impede or inhibit portable device functionality. Accordingly, in many instances, a device or apparatus used to secure a portable communications device to an article of clothing must satisfy functional and operational constraints. In some instances, such as if an individual is wearing protective clothing, such as fire-protective gloves, for example, an apparatus used to secure a portable communications device must provide ample clearance between device controls and the apparatus so that an emergency-services worker may operate the communications device even while wearing such protective clothing.

FIG. 1 is a view of a portable communications device, to which a collar may be secured, according to an embodiment 100. The portable communications device of embodiment 100 may comprise antenna 122, which may facilitate wireless communications, for example, as well as controls 124 and 126, which may function to adjust volume, select channels and/or communication networks, for example. The portable communications device of embodiment 100 may additionally comprise an alphanumeric display 140, which may be disposed adjacent to beveled surface 150 (shown in in greater detail in FIG. 7, herein) at a top or upward-facing surface of the device. Display 140 may permit an emergency services worker to, at a glance, determine one or more operational settings of the device. Although not shown explicitly in FIG. 1, the portable communications device of embodiment 100 may additionally comprise a second, more comprehensive display 240 (of FIG. 2), which may advise an emergency services worker of numerous additional operating parameters of the device, such as frequency, digital network identification, and so forth, on which the portable communications device may receive and transmit audio and/or data signals.

The portable communications device of embodiment 100 may comprise one or more outwardly-tapered surfaces 170 and 175, which may permit an emergency services worker, perhaps wearing fire-protective gloves, for example, to easily grasp and manipulate the device. At a lower portion of the device, below center of gravity 160 shown in FIG. 1, the device may further comprise exposed conductors 130, which may permit the device to be placed on a charging station when not actively in use. The portable communications device of embodiment 100 may comprise additional features, which may be described with reference to additional Figures herein. In addition, it should be noted that claimed subject matter is intended to embrace portable communications devices comprising various physical and functional features, virtually without limitation.

Figure 2:
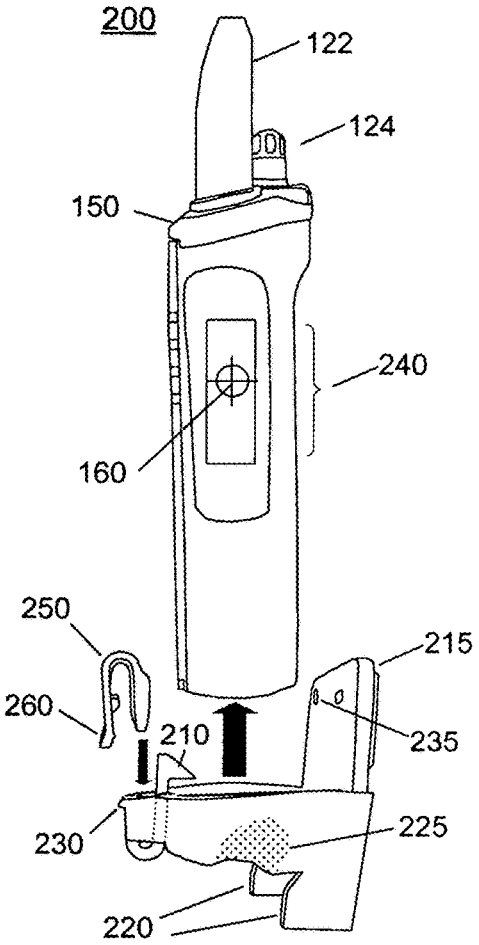
FIG. 2 is a side view of a portable communications device, along with a collar and a retaining clip securable to the portable communications device, according to an embodiment.

FIG. 2 is a side view of a portable communications device, along with a collar and a retaining clip securable to the portable communications device, according to an embodiment 200. As shown in FIG. 2, collar 215, which may comprise a circumferential configuration, may be secured to a portable communications device by sliding the collar in an upward direction relative to the portable communications device. In particular embodiments, shown and/or described further herein, claw 210 may engage at or near beveled surface 150 adjacent to display 140 of FIG. 1. In certain embodiments, retaining clip 250 may be inserted into a receiving volume disposed adjacent to claw 210. At least a portion of retaining clip 250 may be secured within a receiving volume adjacent to claw 210 via a portion of the retaining clip which may ride over, and rest beneath, outcrop 230 of collar 215.

Collar 215 of embodiment 200 may additionally comprise one or more inwardly-tapered surfaces, such as inwardly-tapered surface 225, which may conform with outwardly-tapered surfaces 170 and/or 175 of the portable communications device shown in embodiment 100. Accordingly, as collar 215 is slid longitudinally along the portable communications device, collar 215 may come to rest as an inward-facing side of inwardly-tapered surface 225 contacts outwardly-tapered surface 175, for example. In embodiments, as described further in FIG. 6, inwardly-tapered surface 225 may terminate at a horizontally-oriented lower platform, which may also engage with a portion of outwardly-tapered surface 175, for example.

Collar 215 may additionally comprise eyelet 235, which may accommodate a retaining ring, which may provide an additional means of securing collar 215 to a belt, or other article of clothing, of an emergency services worker, for example. In addition, collar 215 may comprise two fin-shaped protruding features 220, which, responsive to collar 215 engaging with a portable communications device, may come into contact at left and right sides, for example, of a second and more comprehensive display, such as display 240, for example, located at a side surface of the portable communications device.

Figure 3:
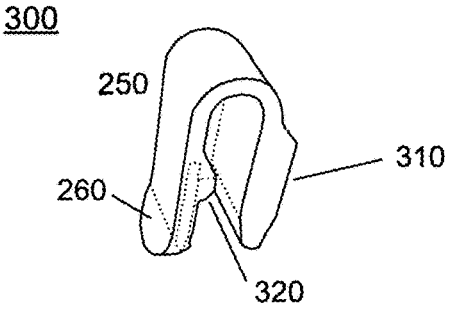
FIG. 3 is a view of a retaining clip, which may assist in securing a collar to a portable communications device according to an embodiment.

FIG. 3 is a view of a retaining clip, which may assist in securing a collar to a portable communications device according to an embodiment 300. As shown in FIG. 3, retaining clip 250 comprises spacer 310, which may function to substantially fill a receiving volume of collar 215 (of FIG. 2) at a location adjacent to claw 210. Accordingly, after sliding collar 215 along the body of a portable communications device, insertion of spacer 310 into a receiving volume adjacent to claw 210, may restrict motion of claw 210. In embodiments, responsive to the restricting of movement of claw 210, collar 215 may be tightly secured around an upper portion of the portable communications device. In embodiments, retaining clip 250 may be retained in place by sliding outcrop 320 over outcrop 230 of claw 210.

Accordingly, after sliding collar 215 into place around an upper portion of a portable communications device, and after insertion of spacer 310 of retaining clip 250 into a receiving volume adjacent to claw 210, collar 215 may be fixedly secured to the portable communications device. Upon removal of retaining clip 250, such as by way of moving outwardly tapered region 260 away from collar 215, retaining clip 250 may be removed. Collar 215 may then be slid in a downward direction, thereby permitting disengagement of the collar from the portable communications device.

Figure 4:
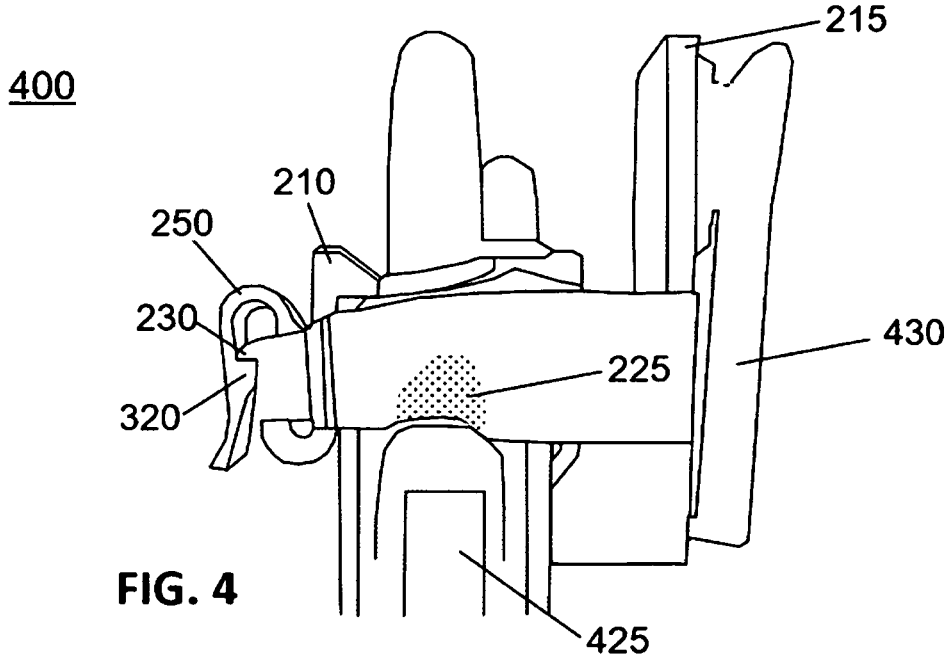
FIG. 4 is a side, view of a collar and retaining clip secured to a portable communications device according to an embodiment.

FIG. 4 is a side view of a collar and retaining clip secured to a portable communications device according to an embodiment 400. As shown in FIG. 4, claw 210 may rest on an upward-facing portion of the portable communications device. Securing claw 210 in place may be accomplished by insertion of a portion of retaining clip 250 into a receiving volume adjacent (such as behind in FIG. 4) claw 210, which may restrict movement of the claw. Retaining clip 250 may be secured into place by permitting outcrop 320 to slide over outcrop 230 of collar 215. As is also shown in FIG. 4, inwardly-tapered surface 225 is disposed over and outwardly-tapered portion of a portable communications device, which may correspond to a location adjacent to remote speaker/microphone connection area 425. In particular embodiments, inwardly-tapered surface 225 may be positioned so as to permit unimpeded connection of a remote speaker/microphone to the portable communications device. The embodiment of FIG. 4 also shows belt clip 430, which may permit securing a portable communications device to a belt or other article of clothing worn by an emergency services worker.

Figure 5:
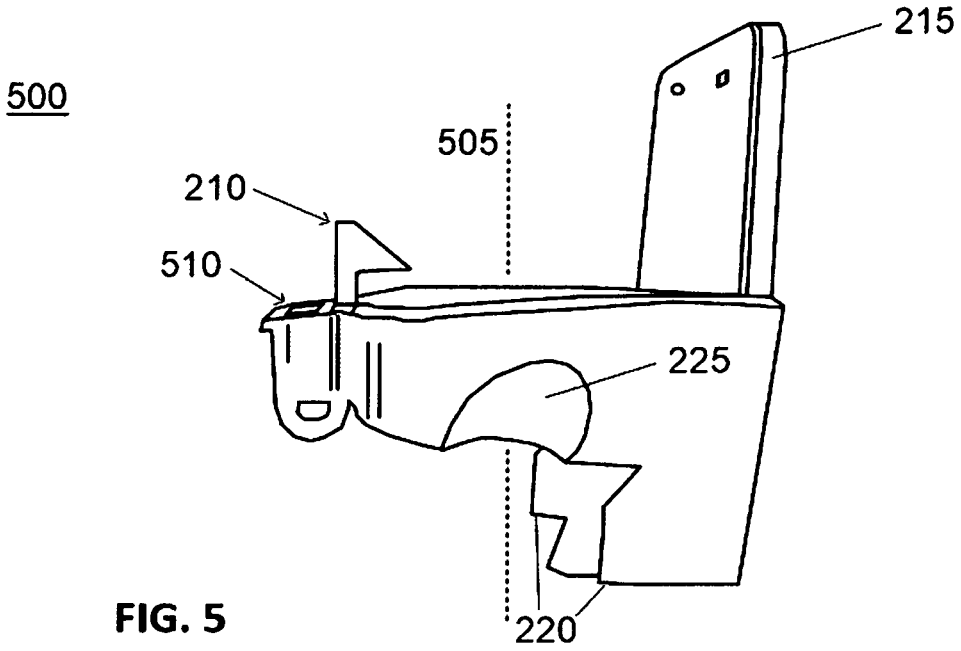
FIG. 5 is a side view of a collar securable to a portable communications device according to an embodiment.

FIG. 5 is a side view of a collar securable to a portable communications device according to an embodiment 500. As shown in FIG. 5, protruding features 220 of collar 215, which, in particular embodiments, maybe fin-shaped, may be grasped between the thumb and one or more forefingers of an average-sized person prior to engagement of the collar with a portable communications device. FIG. 5 also shows central axis 505 extending to the center portion of collar 215. Accordingly, the teeth of claw 210 are shown as oriented in a direction towards central axis 505 of collar 215. Receiving volume 510 can also be seen in FIG. 5 as disposed in a radial direction relative to claw 210. FIG. 5 also shows inwardly-tapered surface 225 sloping in the direction of central axis 505.

Figure 6:
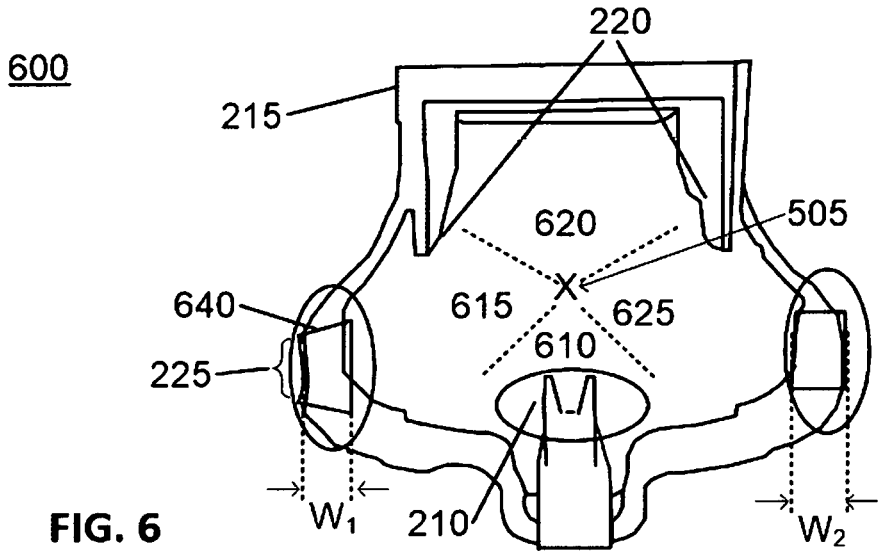
FIG. 6 is a view of the underside of a collar securable to a portable communications device according to an embodiment.

FIG. 6 is a view of the underside of a collar securable to a portable communications device according to an embodiment 600. In FIG. 6, central axis 505 is shown as an "X" at an approximately central location of the circumferential collar of embodiment 600 which may circumscribe a portable communications device, for example. At first quadrant 610, defined by radial lines extending from central axis 505, claw 210 is shown. In particular embodiments, as collar 215 is slid upwards along the body of the portable communications device of embodiment 100 (FIG. 1), first lower platform 640 may engage with outwardly-tapered surface 175 while claw 210 engages with beveled surface 150. Although claw 210 is shown as having two teeth, embodiments of the claimed subject matter may include a claw having any number of teeth, such as one tooth, three teeth, four teeth, and so forth, virtually without limitation. At second quadrant 620, opposite first quadrant 610, protruding features, such as protruding features 220, may permit engagement of collar 215 with, for example, right and left sides of a display located at a lateral side of a portable communications device.

At third quadrant 615, which may be situated between quadrants 620 and 610, inwardly-tapered surface 225 is shown, wherein the inwardly-tapered surface terminates at first lower platform 640. In embodiments, first lower platform 640 may be oriented in a substantially horizontal plane, wherein the substantially horizontal plane intersects, or is perpendicular to, central axis 505. First lower platform 640 may comprise a suitable width ($w_1$) in FIG. 6), which, in particular embodiments, may be selected to contact one of outwardly-tapered surfaces 170 or 175, of FIG. 1 when collar 215 is positioned into place on a portable communications device.

At fourth quadrant 625, which may be situated between first quadrant 610 and second quadrant 620, second lower platform 645 is shown. In embodiments, second lower platform 645 may be oriented in a substantially horizontal plane, wherein the substantially horizontal plane intersects, or is perpendicular to, central axis 505. Second lower platform 645 may comprise a suitable width ($w_2$) in FIG. 6, which, in particular embodiments, may be selected to contact one of outwardly-tapered surfaces 170 and 175 of FIG. 1 when collar 215 is secured into place on a portable communications device.

Figure 7:
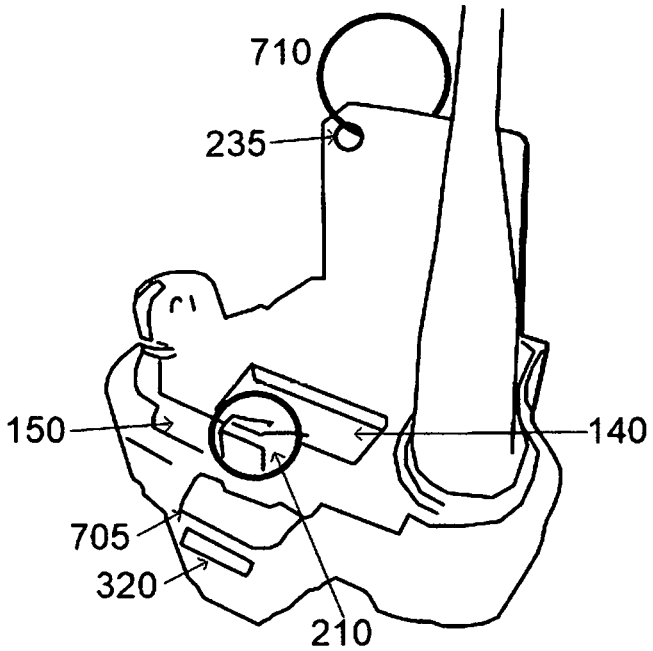
FIG. 7 is a view of a collar secured to a portable communications device according to an embodiment.

FIG. 7 is a view of a collar secured to a portable communications device according to an embodiment 700. As shown in FIG. 7, claw 210, having two teeth, is shown as contacting beveled surface 150 in a manner that does not substantially occlude (or obstruct from view) display 140. Receiving volume 705, which may accommodate a spacer of a retaining clip, such as spacer 310 of retaining clip 250 (of FIG. 3), is shown in a radial direction adjacent to claw 210. Outcrop 320 may also be seen in FIG. 7 as positioned below the entrance of receiving volume 705. Also shown in FIG. 7, retaining ring 710 is shown as having been threaded through eyelet 235 of the collar of embodiment 700.

In embodiments, collar 215, claw 210, protruding features 220, retaining clip 250, and belt clip 430 may be constructed plastic injection molded material. Collar 205 may also be constructed, for example, of glass impregnated nylon, for example or may comprise a thermoplastic polymer, such as a polycarbonate material. However, those skilled in the art may select different materials to satisfy particular requirements, such as weight, durability, resistance to fire and/or chemical corrosives, and so forth.

While there has been illustrated and/or described what are presently considered to be example features, it will be understood by those skilled in the relevant art that various other modifications may be made and/or equivalents may be substituted, without departing from claimed subject matter. Additionally, many modifications may be made to adapt a particular situation to the teachings of claimed subject matter without departing from one or more central concept (s) described herein. Therefore, it is intended that claimed subject matter not be limited to the particular examples disclosed, but that such claimed subject matter may also include all aspects falling within appended claims and/or equivalents thereof.

What is claimed is:

1. An apparatus, comprising:

a circumferential collar, which:

at a first quadrant, comprises a securing claw oriented in the direction of a central axis of the circumferential collar;

at a second quadrant, opposite the first quadrant, comprises two protruding features also oriented in the direction of the central axis of the circumferential collar; and at a third quadrant, the third quadrant being between the first and second quadrants, comprises a first lower platform oriented in a plane perpendicular to the claw and the two protruding features.

2. The apparatus of claim 1, further comprising a retaining clip, the retaining clip securable to the circumferential collar and in contact with the claw.

3. The apparatus of claim 2, wherein the retaining clip comprises an outcrop for securing with an outcrop of the circumferential collar.

4. The apparatus of claim 2, wherein the retaining clip is securable to a location in a radial direction relative to the claw.

5. The apparatus of claim 4, wherein the retaining clip comprises a region that is outwardly tapered in relation to the central axis of the circumferential collar.

6. The apparatus of claim 5, wherein the location in the radial direction relative to the claw corresponds to a receiving volume to accept a spacer of the retaining clip.

7. The apparatus of claim 1, further comprising a portable communications device, the portable communications device to be circumscribed by the circumferential collar.

8. The apparatus of claim 7, wherein the portable communications device comprises a display, and wherein each of the two protruding features is fin shaped and spaced apart from each other so as to make contact at first and second sides of the display of the portable communications device.

9. The apparatus of claim 8, wherein the portable communications device comprises a beveled surface under the securing claw.

10. The apparatus of claim 1, further comprising one or more inwardly-tapered surfaces, the one or more inwardly-tapered surfaces sloping in a direction towards the central axis of the circumferential collar.

11. The apparatus of claim 10, wherein the one or more inwardly-tapered surfaces terminate at the first lower platform.

12. The apparatus of claim 11, wherein the first lower platform is oriented perpendicular to the central axis of the circumferential collar.

13. The apparatus of claim 11, further comprising a portable communications device having an outwardly-tapered surface for engaging with the first lower platform.

14. An apparatus configured to secure a portable communications device to an object, comprising:

a circumferential collar for surrounding an area of the portable communications device;

one or more inwardly-tapered surfaces terminating at a corresponding one or more lower platforms, the one or more lower platforms for engaging outwardly tapered areas of the portable communications device;

a claw for engaging a beveled surface of the portable communications device; and a spacer for restricting movement of the claw, wherein the spacer forms a portion of a retaining clip, the retaining clip securable to the circumferential collar and in contact with the claw.

15. The apparatus of claim 14, wherein the retaining clip comprises an outcrop for securing with an outcrop of the circumferential collar.

16. The apparatus of claim 14, wherein the spacer engages and fills a receiving volume adjacent to the claw.

17. The apparatus of claim 14, wherein the one or more lower platforms are oriented in a direction perpendicular to a central axis of the circumferential collar.

18. The apparatus of claim 14, wherein the one or more inwardly-tapered surfaces are disposed adjacent to a remote speaker/microphone connection area of the portable communications device.

* * * * *